US006276774B1

(12) United States Patent
Moghadam et al.

(10) Patent No.: US 6,276,774 B1
(45) Date of Patent: Aug. 21, 2001

(54) IMAGING APPARATUS CAPABLE OF INHIBITING INADVERTENT EJECTION OF A SATELLITE INK DROPLET THEREFROM AND METHOD OF ASSEMBLING SAME

(75) Inventors: Omid A. Moghadam, Rochester; Anthony R. Lubinsky, Penfield; Christopher N. Delametter; Thomas E. Kocher, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/083,679

(22) Filed: May 22, 1998

Related U.S. Application Data

(60) Provisional application No. 60/072,414, filed on Jan. 24, 1998.

(51) Int. Cl.[7] ..... B41J 29/38; B41J 29/393; B41J 2/165; B41J 2/125

(52) U.S. Cl. ..... 347/11; 347/10; 347/9; 347/11; 347/19; 347/23; 347/81

(58) Field of Search ..... 347/11, 19, 23, 347/10, 9, 81, 68

(56) References Cited

U.S. PATENT DOCUMENTS

| | | | | |
|---|---|---|---|---|
| 4,695,852 | | 9/1987 | Scardovi | 347/11 |
| 4,743,924 | | 5/1988 | Scardovi | 347/11 |
| 4,752,790 | | 6/1988 | Scardovi | 347/19 |
| 5,170,177 | * | 12/1992 | Stanley et al. | 347/11 |

FOREIGN PATENT DOCUMENTS

| | | | | |
|---|---|---|---|---|
| 0 200 457 | * | 11/1986 | (EP) | 347/11 |

OTHER PUBLICATIONS

Xin Wen, "Printer Apparatus Capable Of Varying Direction Of An Ink Droplet To Be Ejected Therefrom And Method Therefor", U.S. application No. 09/036,012 filed Mar. 6, 1998.

Oosterbroek et al., "Designing, realization and characterization of a novel capacitive pressure/flow sensor", Jun. 16, 1997, pp. 151–154.

* cited by examiner

*Primary Examiner*—John Barlow
*Assistant Examiner*—Charles W. Stewart, Jr.
(74) *Attorney, Agent, or Firm*—Francis H. Boos, Jr.; Roland R. Schindler, II

(57) ABSTRACT

An imaging apparatus capable of inhibiting inadvertent ejection of a satellite ink droplet and method of assembling same. The imaging apparatus comprises a print head transducer including a pair of sidewalls defining a chamber therebetween, the channel having the ink body disposed therein. The transducer is in fluid communication with the ink body for inducing a first pressure wave in the ink body in order to eject an ink droplet. A waveform generator is connected to the transducer for supplying voltage waveforms to the transducer, so that the transducer induces pressure waves in the ink body. However, the first pressure wave has a reflected portion formed by the first pressure wave reflecting from the sidewalls. The reflected portion is sufficient to otherwise inadvertently eject unintended satellite ink droplets. Thus, a sensor is in fluid communication with the ink body for sensing the reflected portion and is connected to the transducer for inducing a second pressure wave in the ink body. The second pressure wave has an amplitude and phase damping the reflected portion of the first pressure wave in order to the inhibit inadvertent ejection of satellite ink droplets.

40 Claims, 6 Drawing Sheets

IMAGE SOURCE
IMAGE PROCESSOR
DIGITAL HALFTONING
IMAGE MEMORY
INK PRESSURE REGULATOR
CONTROLLER
WAVEFORM GENERATOR
TRANSPORT CONTROL SYSTEM
AMPLIFIER
SWITCH
FEED BACK CIRCUIT
SEE FIG. 1B 10
25
30
40
50
60
70
80
85
90
100
110
120
130
140
150
160
170
205
260
285
320
340
365
370

IMAGING APPARATUS CAPABLE OF INHIBITING INADVERTENT EJECTION OF A SATELLITE INK DROPLET THEREFROM AND METHOD OF ASSEMBLING SAME

CROSS REFERENCE TO RELATED APPLICATION

Reference is made to and priority claimed from U.S. Provisional Application Serial No. U.S. 60/072,414 filed Jan. 24, 1998, entitled DROP-ON-DEMAND INKJET PRINTING WITH CAVITY DAMPING.

BACKGROUND OF THE INVENTION

The present invention relates to imaging apparatus and methods and more particularly relates to an imaging apparatus capable of inhibiting inadvertent ejection of a satellite ink droplet therefrom and method of assembling same.

An imaging apparatus, such an ink jet printer, produces images on a receiver medium by ejecting ink droplets onto the receiver medium in an image-wise fashion. The advantages of non-impact, low-noise, low energy use, and low cost operation in addition to the ability of the printer to print on plain paper are largely responsible for the wide acceptance of ink jet printers in the marketplace.

One such ink jet printer is disclosed in commonly assigned U.S. patent application Ser. No. 09/036,012, titled "Printer Apparatus Capable Of Varying Direction Of An Ink Droplet To Be Ejected Therefrom And Method Therefor" filed Mar. 6, 1998 in the name of Xin Wen. The ink jet printer of the Wen disclosure includes a piezoelectric print head capable of varying direction of an ink droplet to be ejected from the print head. A pair of sidewalls belonging to the print head define an ink channel therebetween containing ink. The print head includes addressable electrodes attached to the side walls for actuating (i.e., moving) the sidewalls, so that the ink droplet is ejected from the ink channel. In this regard, a pulse generator applies time and amplitude varying electrical pulses to the addressable electrodes for actuating the sidewalls, so that the ink droplet is ejected from the ink channel.

More specifically, when the side walls of the Wen device inwardly move due to the actuation thereof, a pressure wave is established in the ink contained in the channel. As intended, this pressure wave squeezes a portion of the ink in the form of the ink droplet out the channel. However, as the pressure wave ejects the ink droplet, the pressure wave impacts the sidewalls defining the channel and is reflected therefrom. The pressure wave reflected from the sidewalls establishes a reflected pressure wave in the channel, this reflected pressure wave being defined herein as a "reflected portion" of the incident pressure wave. Of course, if the time between actuations of the sidewalls is sufficiently long, the reflected portion dies-out before each actuation of the sidewalls.

However, the reflected portion of the pressure wave may be of amplitude sufficient to inadvertently eject an unintended so-called "satellite droplet" following ejection of the intended ink droplet. Satellite ink droplet formation is undesirable because such inadvertent satellite ink droplet formation interferes with precise ejection of ink droplets from the ink channels, which leads to ink droplet placement errors. These ink droplet placement errors in turn produce image artifacts such as banding, reduced image sharpness, extraneous ink spots, ink coalescence and color bleeding. Thus, a problem in the art is satellite ink droplet formation leading to ink droplet placement errors.

In addition, as stated hereinabove, if the time between actuations of the sidewalls is sufficiently long, the reflected portion of the pressure wave eventually dies-out. Thus, in order to avoid satellite ink droplet formation, printer speed is selected such that electrical pulses are applied to the addressable electrodes at intervals after each reflected portion dies-out. Such delayed printer operation is required in order to avoid the unintended reflected portion interfering with the intended pressure wave. Otherwise allowing the reflected portion to interfere with the intended pressure wave may result in the afore mentioned ink droplet placement errors. However, operating the printer in this manner reduces printing speed because ejection of ink droplets must await the cessation of the reflected portion of the pressure wave. Therefore, another problem in the art is reduced printer speed due to presence of the reflected portion of the pressure wave.

Therefore, there has been a long-felt need to provide an imaging apparatus and method capable of inhibiting inadvertent formation of the reflected portion of the pressure wave.

SUMMARY OF THE INVENTION

An object of the present invention is to provide an imaging apparatus capable of inhibiting inadvertent ejection of an ink droplet from an ink body residing in the imaging apparatus, and method of assembling the apparatus.

With this object in view, the invention resides in an imaging apparatus having a chamber therein, comprising a transducer coupled to the chamber for inducing a first pressure wave in the chamber, the first pressure wave having a reflected portion; and a sensor coupled to the chamber for sensing the reflected portion and connected through a feedback circuit to the transducer for actuating the transducer in response to the reflected portion sensed thereby, so that the transducer actuates to induce a second pressure wave in the chamber damping the reflected portion.

According to one aspect of the present invention, an imaging apparatus is provided that is capable of inhibiting inadvertent ejection of an ink droplet from an ink body residing in the imaging apparatus. The imaging apparatus comprises a print head defining a chamber having the ink body disposed therein. A transducer is in fluid communication with the ink body for inducing a first pressure wave in the ink body, which first pressure wave has a reflected portion of a first amplitude and a first phase sufficient to inadvertently eject satellite droplets. In this regard, a waveform generator and amplifier are connected to the transducer for supplying a first voltage waveform to the transducer, so that the transducer induces the first pressure wave in the ink body. In addition, a sensor is in fluid communication with the ink body for sensing the reflected portion and for generating a second voltage waveform in response to the reflected portion sensed thereby. Moreover, a feedback circuit is connected to the sensor for receiving the second voltage waveform generated by the sensor. The feedback circuit converts the second voltage waveform to a third voltage waveform whose amplitude and phase are chosen by the feedback circuit to drive the reflected pressure waves and thus the second voltage waveform to zero as rapidly as possible, and transmits the third voltage waveform to the amplifier. The amplifier receives the third voltage waveform and supplies the amplified third voltage waveform to the transducer, so that the transducer controllably actuates in response to the third voltage waveform supplied thereto. This third voltage waveform induces a second pressure wave in the ink body. The second pressure wave has a second amplitude and a second phase which damps the amplitude of the reflected portion of the first pressure wave in order to the inhibit inadvertent ejection of satellite ink droplets.

The imaging apparatus further comprises a switch capable of switching between a first operating mode and a second operating mode. When the switch switches to the first operating mode, the switch connects the waveform generator and amplifier to the transducer for actuating the transducer in order to produce the first pressure wave in the chamber. When the switch switches to the second operating mode, the switch connects the sensor and feedback circuit and amplifier to the transducer for sensing the reflected portion of the first pressure wave and for damping the reflected portion in the manner mentioned hereinabove.

A feature of the present invention is the provision of a sensor coupled to the chamber for sensing the reflected portion of the first pressure wave.

Another feature of the present invention is the provision of a feedback circuit connected to the sensor and the amplifier for controllably applying the second pressure wave to the ink body, such that the second pressure wave damps the reflected portion of the first pressure wave.

An advantage of the present invention is that satellite ink droplet formation is inhibited.

Another advantage of the present invention is that printing speed is increased.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1A, 1B:
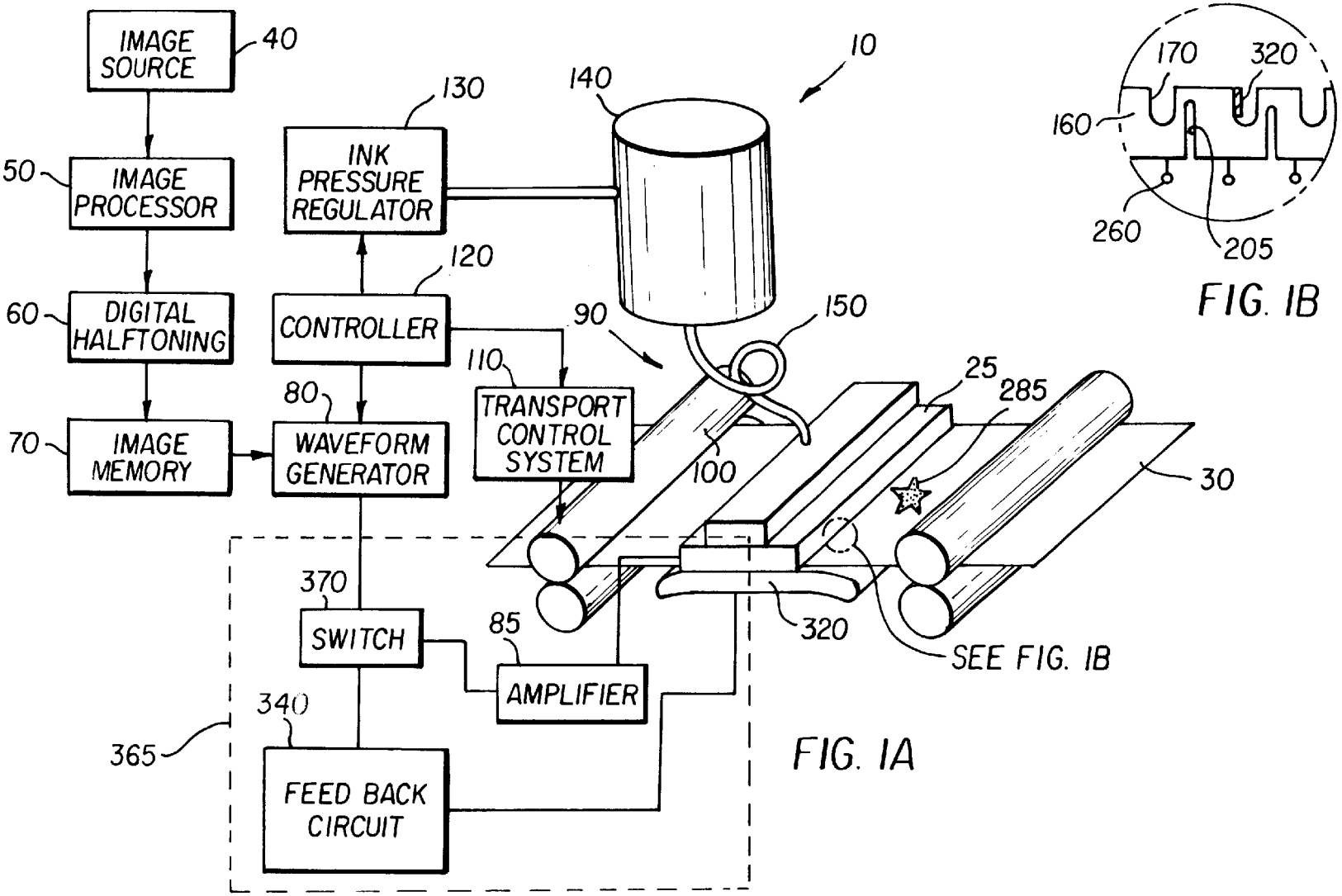
FIG. 1 illustrates an imaging apparatus belonging to the present invention, the imaging apparatus comprising a print head.
Figure 3:
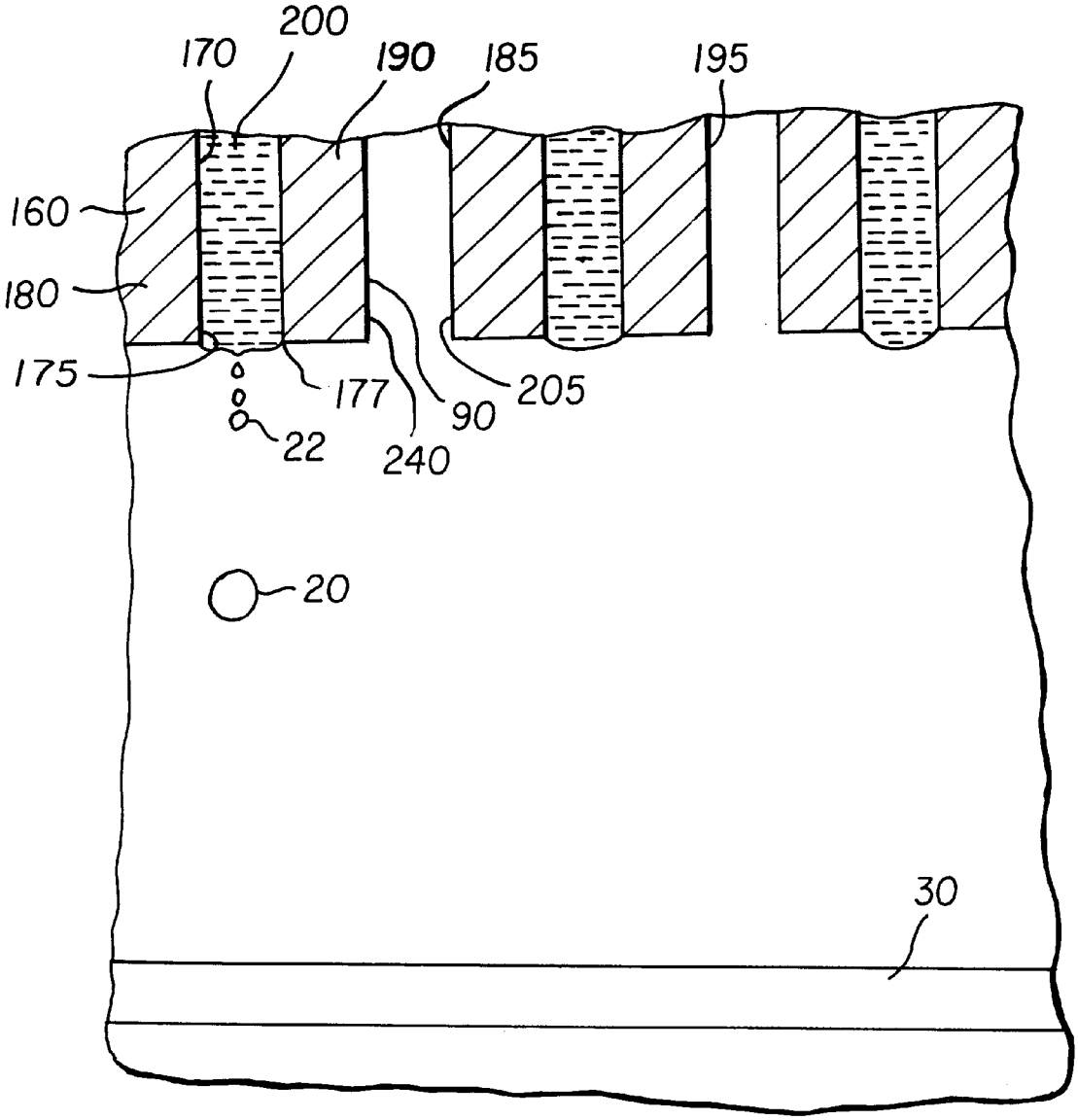
FIG. 3 is a fragmentation view in horizontal section of the print head, this view also showing an ink droplet being ejected from the ink chamber followed by a plurality of satellite ink droplets weeping from the chamber.

Therefore, referring to FIG. 1, there is shown the subject matter of the present invention, which is an imaging apparatus, generally referred to as 10, for ejecting an ink droplet 20 from a print head 25 toward a receiver 30 (see FIG. 3). In this regard, receiver 30 may be a reflective-type (e.g., paper) or transmissive-type (e.g., transparency) receiver. Although apparatus 10 is capable of ejecting droplet 20, apparatus 10 is also capable of inhibiting inadvertent ejection of a so-called "satellite ink droplet" 22, as described in detail hereinbelow.

As shown in FIG. 1, imaging apparatus 10, which is preferably an ink jet printer, comprises an image source 40, which may be raster image data from a scanner or computer, or outline image data in the form of a PDL (Page Description Language) or other form of digital image representation. This image data is transmitted to an image processor 50 connected to image source 40. Image processor 50 converts the image data to a pixel-mapped page image. Image processor 50 may be a raster image processor in the case of PDL image data to be converted, or a pixel image processor in the case of raster image data to be converted. In any case, image processor 50 transmits continuous tone data to a digital halftoning unit 60 connected to image processor 50. Halftoning unit 60 halftones the continuous tone data produced by image processor 50 and produces halftoned bitmap image data that is stored in an image memory 70, which may be a full-page memory or a band memory depending on the configuration of imaging apparatus 10. A waveform generator 80 connected to image memory 70 reads data from image memory 70 and applies time and amplitude varying electrical stimuli through an amplifier 85 to an electrical actuator (i.e., an electrode), as described more fully hereinbelow.

Referring again to FIG. 1, receiver 30 is moved relative to print head 25 by means of a transport mechanism 90, such as rollers 100, which are electronically controlled by a transport control system 110. Transport control system 110 in turn is controlled by a suitable controller 120. It may be appreciated that different mechanical configurations for transport control system 110 are possible. For example, in the case of pagewidth print heads, it is convenient to move receiver 30 past a stationary print head 25. On the other hand, in the case of scanning-type printing systems, it is more convenient to move print head 25 along one axis (i.e., a sub-scanning direction) and receiver 30 along an orthogonal axis (i.e., a main scanning direction), in a relative raster motion. In addition, if desired, controller 120 may be connected to an ink pressure regulator 130 for controlling regulator 130. Regulator 130, if present, is capable of regulating pressure in an ink reservoir 140. Ink reservoir 140 is connected, such as by means of a conduit 150, to print head 25 for supplying liquid ink to print head 25. In this regard, ink is preferably distributed to a back surface of print head 25 by an ink channel device (not shown) belonging to print head 25.

Figure 2:
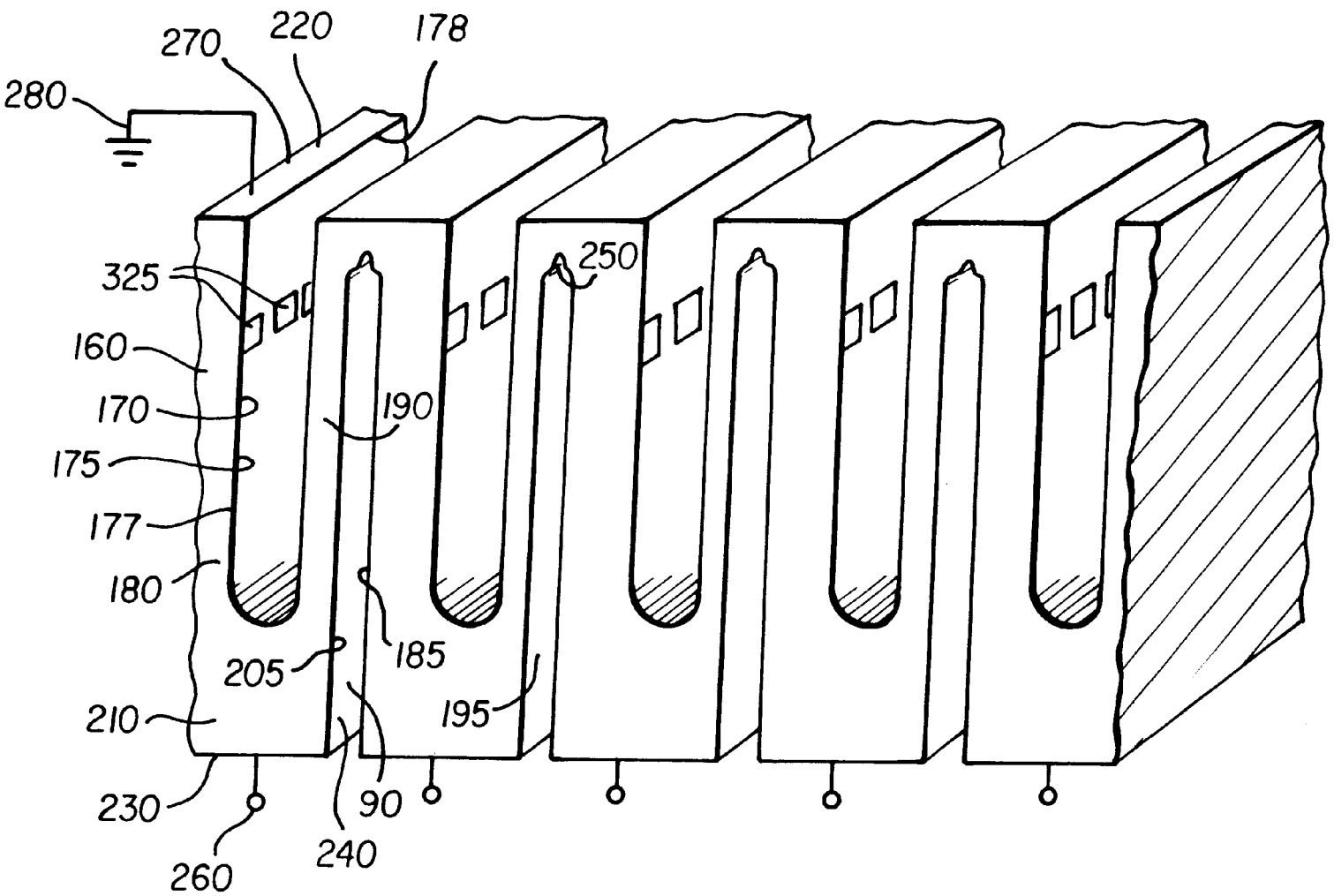
FIG. 2 is a fragmentation view in perspective of the print head with parts removed for clarity, this view showing a plurality of ink chambers formed in the print head, each ink chamber being defined by a pair of sidewalls belonging to the print head.

Referring to FIGS. 2 and 3, print head 25 comprises a generally cuboid-shaped preferably one-piece transducer 160 formed of a piezoelectric material, such as lead zirconate titanate (PZT), which is responsive to electrical stimuli. Cut into transducer 160 are a plurality of elongate ink chambers 170. Each of the chambers 170 has a chamber outlet 175 at an end 177 thereof and an open side 178 extending the length of chamber 170. Ink chambers 170 are covered at outlets 175 by a nozzle plate (not shown) having a plurality of orifices (also not shown) aligned with respective ones of chamber outlets 175, so that ink droplets 20 are ejected from chamber outlets 175 and through their respective orifices in the nozzle plate along a trajectory normal to the nozzle plate. A rear cover plate (not shown) is also provided for capping the rear of chambers 175. In addition, a top cover plate (also not shown) caps chambers 170 along open side 178. During operation of apparatus 10, ink from reservoir 140 is controllably supplied to each chamber 175 by means of conduit 150.

Still referring to FIGS. 2 and 3, transducer 160 includes a first side wall 180 and a second side wall 190 defining chamber 170 therebetween, which chamber 170 is adapted to receive an ink body 200 therein. Moreover, cut into transducer 160 between adjacent chambers 170 and extending parallel thereto is a cut-out 205 separating chambers 170 for reducing mechanical coupling (i.e., "cross-talk") between chambers 170. Each first side wall 180 has an outside surface 185 facing cut-out 205 and each second side wall 190 has an outside surface 195 also facing cut-out 205. Transducer 160 also includes a base portion 210 interconnecting first side wall 180 and second side wall 190, so as to form a generally U-shaped structure of the piezoelectric material. Upper-most surfaces (as shown) of first wall 180 and second wall 190 together define a top surface 220 of transducer 160. A lower-most surface (as shown) of base portion 210 defines a bottom surface 230 of transducer 160. In addition, an addressable electrode actuator layer 240 extends downwardly from approximately one-half the height of outside surface 185, across bottom surface 230, and upwardly to approximately one-half the height outside surface 195. A notch 250 is cut into transducer 160 along the length of the top of cut-out 205, such that notch 250 extends in transducer 160 to the same lengthwise extent as cut-out 205. The purpose of notch 250 is to form segregated portions of addressable electrode layer 240 that are electrically disconnected due to presence- of notch 250. In this manner, portions of addressable electrode layer 240 are associated with respective ones of chambers 170. In this configuration of addressable electrode layer 240, an electrical field (not shown) is established in a orientation to actuate sidewalls 180/190, as described in more detail hereinbelow. Moreover, each of the portions of addressable electrode layer 240 is connected to the previously mentioned waveform generator 80 and amplifier 85. In this regard, waveform generator 80 supplies electrical stimuli to each of the portions of addressable electrode layer 240 via an electrical conducting terminal 260.

Referring yet again to FIGS. 2 and 3, a common electrode layer 270 coats each chamber 170 and also extends therefrom along top surface 220. Common electrode layer 270 is preferably connected to a ground electric potential, as at a point 280. When waveform generator 80 supplies electrical stimuli to addressable electrode actuator layer 240, the previously mentioned electric field (not shown) is established between addressable electrode actuator layer 240 and common electrode layer 270. This electric field in piezoelectric sidewalls 180/190 deforms and inwardly moves sidewalls 180/190. As sidewalls 180/190 deform, ink droplet 20 is ejected from chamber 170 in order to form an image 290 (see FIG. 1) on receiver 30.

Figure 4:
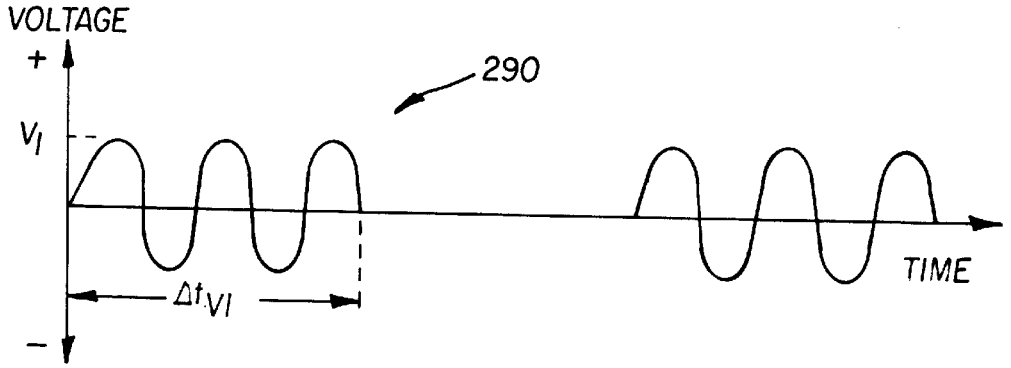
FIG. 4 shows a graph of a first voltage waveform applied to any one of the pairs of sidewalls for actuating the sidewalls, so that an intended ink droplet is ejected from the ink channel.
Figure 5:
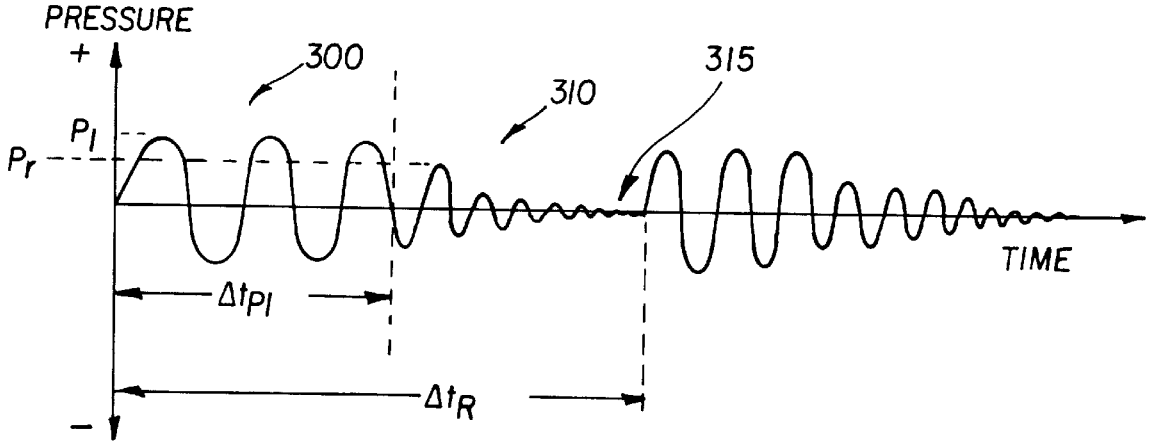
FIG. 5 shows a graph of a first pressure wave produced in the channel as the first voltage waveform is applied, the first pressure wave having a reflected portion thereof.
Figure 6:
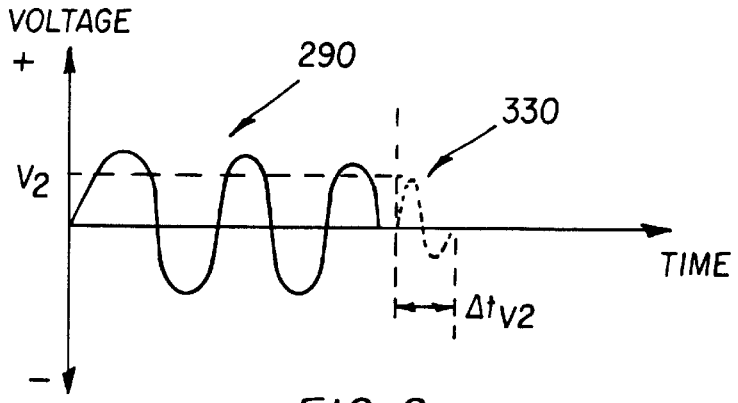
FIG. 6 shows a graph of a second voltage waveform in combination with the first voltage waveform, the second voltage waveform being produced in response to the reflected portion of the first pressure wave.
Figure 7:
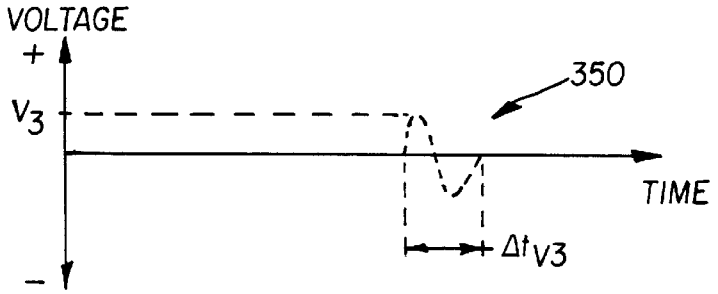
FIG. 7 shows a graph of a third voltage waveform, the third voltage waveform being applied to the actuated pair of sidewalls to damp the reflected portion of the first pressure wave.
Figure 8:
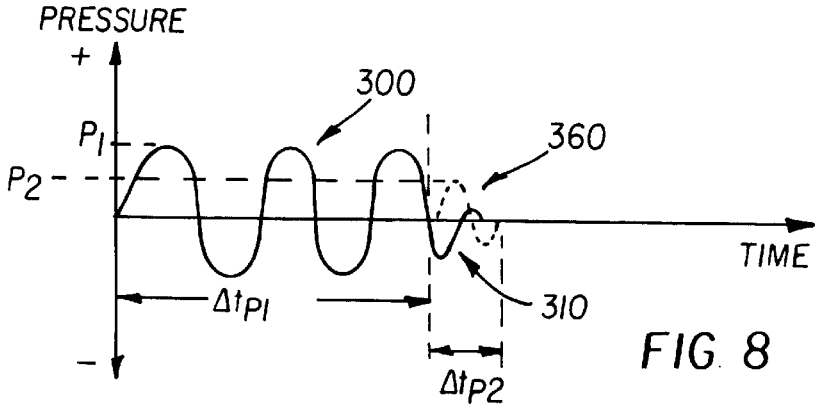
FIG. 8 shows a graph of a second pressure wave in combination with the first pressure wave, the second pressure wave being produced in the ink chamber as the third voltage waveform is applied, so that the second pressure wave damps the reflected portion of the first pressure wave.

Turning now to FIGS. 4 and 5, there is shown a first electrical waveform, generally referred to as 290, for inducing a first pressure wave, generally referred to as 300, in ink body 200. First pressure wave 300 is induced in ink body 200 in order to squeeze ink droplet 20 from ink body 200 and thereby eject ink droplet 20 from chamber 170. In this regard, waveform generator 80 supplies first voltage waveform 290 through amplifier 85 to a selected portion of addressable electrode layer 240, via terminal 260, in order to electrically stimulate a pair of sidewalls 180/190 so as to deform sidewalls 180/190. First electrical waveform 290 has a voltage amplitude $V_1$ and a time duration $\Delta t_{V1}$. As stated hereinabove, when sidewalls 180/190 deform, first pressure wave 300 is induced in ink body 200. This first pressure wave 300 has a first amplitude $P_1$ and a first time duration $\Delta t_{P1}$. However, first pressure wave 300 is reflected from sidewalls 180/190 and, unless inhibited, forms an undesirable reflected portion 310 of first pressure wave 300. Unless suppressed, reflected portion 310 will have a. maximum pressure amplitude $P_r$ lower than amplitude $P_1$, to be followed by successively lower amplitudes until reflected portion 310 dies-out, as generally shown at point 315. Also, reflected portion 310 of first pressure wave 310 may have amplitudes sufficient to inadvertently eject so-called "satellite" droplet 22 following ejection of the intended ink droplet 20. Satellite ink droplet formation is undesirable because such satellite ink droplet formation interferes with precise ejection of ink droplets 20 from ink chambers 170, which in turn leads to ink droplet placement errors. Moreover, if a time duration $\Delta t_R$ between successive actuations of sidewalls 180/190 is sufficiently long, reflected portion 310 of first pressure wave 300 eventually dies-out. Thus, in order to avoid formation of satellite ink droplets 22, printer speed must be reduced in order that waveform 290 be applied to addressable electrode 240 at intervals after each reflected portion 310 dies-out so that reflected portion 310 does not interfere with proper ejection of subsequent "intended" ink droplets 20.

Accordingly, referring to FIGS. 1, 2, 6, 7 and 8, a sensor 320 is coupled to each chamber 170 by means of a suitable pressure sensor, such as a relatively thin sensor diaphragm 325, disposed in each chamber 170. Preferably there are a plurality of sensor diaphragms 325 distributed along the length of chamber 170. In this manner, each sensor diaphragm 325 is in fluid communication with ink body 200. The purpose of sensor 320 and sensor diaphragms 325 is to sense pressure changes in chamber 170 by sensing presence of reflected portion 310 of first pressure wave 300. It may be understood from the teachings herein, that reflected portion 310 gives rise to pressure changes in chamber 170. As sensor 320 senses presence of reflected portion 310, sensor 320 generates a second voltage waveform, generally referred to as 330, in response to the reflected portion 310 sensed thereby. In this regard, second voltage waveform 330 has an amplitude $V_2$ and a time duration $\Delta t_{V2}$. A suitable sensor 320 usable with the invention may be of a type disclosed in a article titled "Designing, Realization And Characterization Of A Novel Capacative Pressure/Flow Sensor" authored by R. E. Oosterbroek and published in the Proceedings, IEEE Transducers Conference, 1997, pages 151-14 154.

Still referring to FIGS. 1, 2, 6, 7 and 8, a feedback circuit (i.e., a calculator) 340 is connected to sensor 320 for receiving second voltage waveform 330. Feedback circuit 340 is capable of converting second voltage waveform 310 to a third voltage waveform 350 to be applied through an amplifier 85 to addressable electrode layer 240 in order to damp reflected portion 310. More specifically, feedback circuit 340 calculates a suitable third voltage waveform 350 based on second voltage waveform 310 which is received from sensor 320, as described in detail hereinbelow. Third voltage waveform 350 is generated by the feedback circuit 340 so as to have an amplitude $V_3$ and a time duration $\Delta t_{V3}$ to drive the input second voltage 310 to zero, and thus dampen the reflected portion 310 of first pressure wave 300. Feedback circuit 340 is connected to amplifier 85 for transmitting this third voltage waveform 350 to transducer 160. Amplifier 85 receives third voltage waveform 350 transmitted by feedback circuit 340 and supplies third voltage waveform 350 to addressable electrode actuator layer 240 through amplifier 85. Addressable electrode layer 240 receives third voltage waveform 350 in order to deform sidewalls 180/190 belonging to transducer 160. Deformation of sidewalls 180/190 thereafter induces a second pressure wave, generally referred to as 360, in ink body 200. Second pressure wave 360 has an amplitude $P_3$ and a time duration $\Delta t_{P3}$. In this manner, second pressure wave 360 has amplitude $P_3$ and a phase (as shown) that effectively damps reflected portion 310, so that satellite droplets 22 are not formed and so that printing speed is capable of being increased. Moreover, sensor 320 and feedback circuit 340 are arranged so as to define a feed-back loop 365, for reasons disclosed hereinbelow.

As previously mentioned, feedback circuit 340 calculates third voltage waveform 350 based on second voltage waveform 310 received from sensor 320. It is the amplified third voltage waveform 350 that is supplied to sidewalls 180/190 to damp reflected portion 310. The preferred manner in which feedback circuit 340 performs this calculation will now be described. In this regard, sensor 320 is first calibrated in open-loop mode. That is, a known voltage $V_3$ is applied through amplifier 85 to transducer 160, which will produce a resulting pressure P in the ink chamber 170, which in turn will cause the sensor 320 to produce a voltage $V_{sense}$, which depends on the magnitude of P. This is then repeated for subsequent applied voltages $V_3$, in order to determine a quantitative relation between $V_3$ and $V_{sense}$, as in Equation (1):

$$V_{sense}=G*V_3 \qquad \text{Equation (1)}$$

where,

G=Gain of amplifier 85, transducer 160, and sensor 320.

Then, when the feedback loop 365 is closed by switch 370 during operation, the third voltage $V_3$, which is supplied to the amplifier 85 and transducer 160 is chosen as:

$$V_3=-(1/G)*V_2 \qquad \text{Equation (2)}$$

The third voltage output signal $V_3$ will in turn cause a second pressure wave 360 in the ink chamber 170, which will exactly cancel the original reflected wave 310 that led to the sensor signal $V_2$, and will quickly cause the sensor signal to become zero, as the pressure waves in the cavity are quickly damped out. The circuit which implements Equation (2) may easily be composed of an inverter, followed by a multiplier.

It will also be appreciated by those skilled in the art that the calibration relation, Equation (2), between $V_3$ and $V_{sense}$ may be captured in a look-up table (LUT). The operation of forming the output signal $V_3$ may also be accomplished by digital signal processing (DSP) circuitry, embodied in a micro-controller, which is in communication with above mentioned LUT.

Returning now to FIG. 1, imaging apparatus 10 further comprises a switch 370. Switch 370 is capable of switching between a first operating mode and a second operating mode. In the first operating mode, switch 370 connects waveform generator 80 to amplifier 85 and transducer 160. Thus, in the first operating mode of switch 370, waveform generator 80 drives amplifier 85 and transducer 160 to eject ink droplet 20. In the second operating mode, which is after transducer 160 ejects droplet 20 and simultaneously with onset of reflected portion 310, switch 370 connects transducer 160 and amplifier 85 to feedback circuit 340, which belongs to feed-back loop 365. In the second operating mode of switch 370, sensor 320 senses presence of reflected portion 310 belonging to first pressure wave 300. A suitable switch 370 may be a so-called "T-switch" such as is available from Siliconix Corporation located in Santa Clara, Calif.

Figure 9:
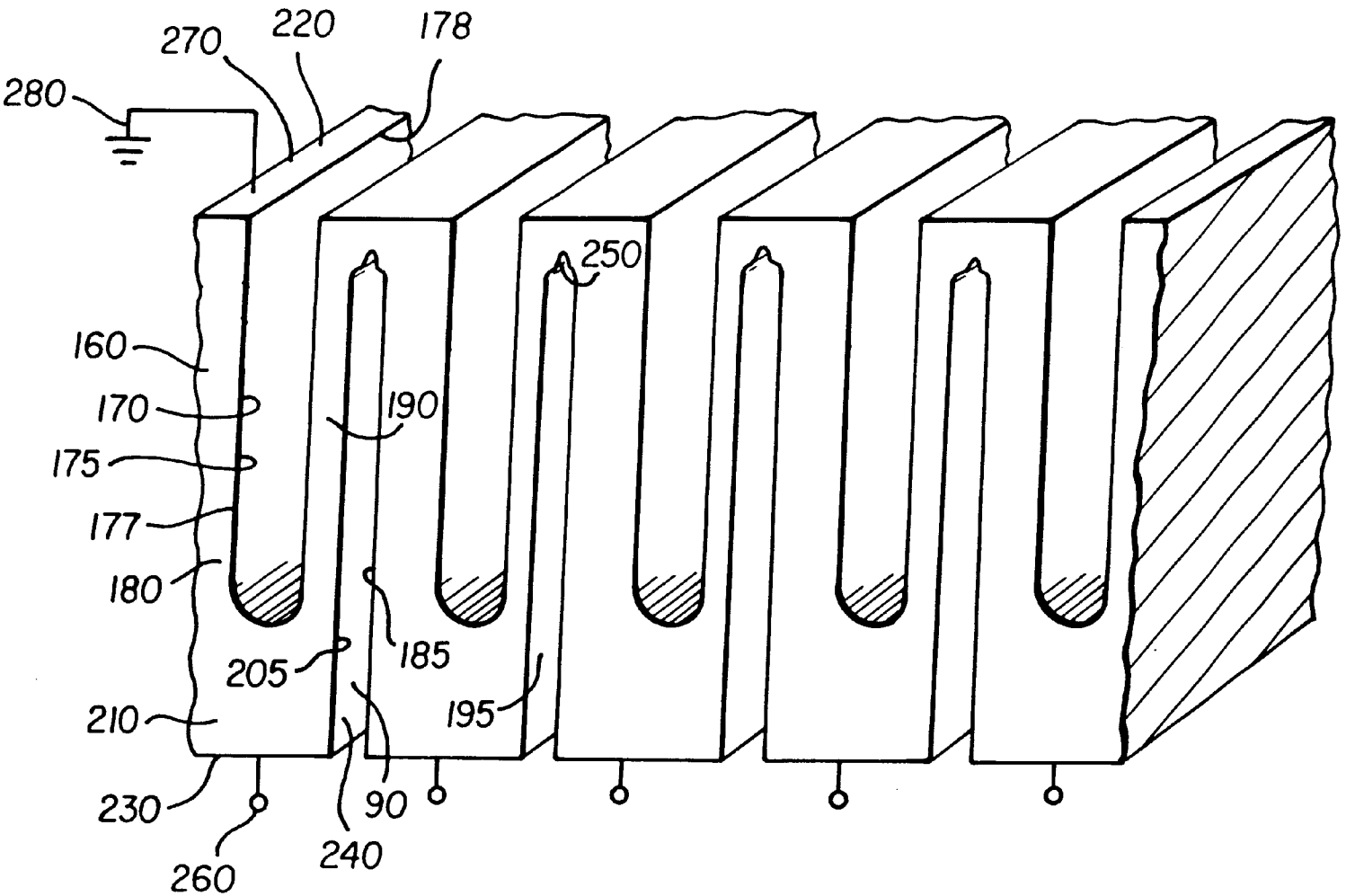
FIG. 9 is a fragmentation view in perspective of an alternative embodiment of the print head with parts removed for clarity.

As best seen in FIG. 9, an alternative embodiment of transducer 160 is there shown with sensor diaphragms 325 absent. In this regard, it is known that when an electrical signal is applied to a piezoelectric material, mechanical distortion occurs in the piezoelectric material due to formation of an electric field caused by the electrical signal. This inherent phenomenon of piezoelectric materials is relied upon to deform sidewalls 180/190 to eject ink droplet 20. Similarly, it is known that when a piezoelectric material deforms, the piezoelectric material gives rise to an electric field. That is, due to the inherent nature of piezoelectric materials, when reflected portion 310 moves sidewalls 180/190, an electric field is induced in sidewalls 180/190. This latter electric field and corresponding voltage can be detected by a suitable device, such as feedback circuit 340. Thus, according to this second embodiment of present invention, sensor 320 is integrally formed with transducer 160 in the sense that transducer 160 functions as the sensor. The advantage of this second embodiment of the invention is that fewer components are necessary. Fewer components present in imaging apparatus 10 reduces cost of assembling imaging apparatus 10. This is due to the fact that a separate sensor 320 is not needed because transducer 160 performs the combined functions of ejecting ink droplet 20 as well as sensing reflected portion 310 of pressure wave 300.

It is understood from the description hereinabove that an advantage of the present invention is that satellite ink droplet formation is inhibited. This is so because second pressure wave 360 damps reflected portion 310 of first pressure wave 300, which reflected portion 310 might otherwise cause ejection of satellite droplets 22.

It is also understood from the description hereinabove that another advantage of the present invention is that printing speed is increased. This is so because imaging apparatus 10 need not wait for reflected portion 310 to die-out before ejecting a subsequent ink droplet 20. Presence of reflected portion 310 might otherwise interfere with proper ejection of ink droplet 20. That is, second pressure wave 360 effectively damps reflected portion 310, so that reflected portion 310 dies-out sooner.

The invention has been described in detail with particular reference to certain preferred embodiments thereof, but it will be understood that variations and modifications can be effected within the spirit and scope of the invention. For example, first waveform 290, second waveform 330, and third waveform 350 are shown as sinusoidal. However, waveforms 290/330/350 may take any one of various shapes, such as triangular or square-shape.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an imaging apparatus capable of inhibiting inadvertent ejection of a satellite ink droplet therefrom, and method of assembling the apparatus.

PARTS LIST

G . . . gain of amplifier
$P_1$ . . . amplitude of first pressure wave
$P_2$ . . . amplitude of second pressure wave
$P_r$ . . . amplitude of reflected portion of first pressure wave
$V_{sense}$ . . . voltage amplitude produced by the sensor du to presence of second voltage waveform
$V_1$ . . . amplitude of first voltage waveform
$V_2$ . . . amplitude of second voltage waveform
$V_3$ . . . amplitude of third voltage waveform
$\Delta t_{V1}$ . . . time duration of first voltage waveform
$\Delta t_{V2}$ . . . time duration of second voltage waveform
$\Delta t_{v3}$ . . . time duration of third voltage waveform
$\Delta t_{P1}$ . . . time duration of first pressure pulse
$\Delta t_{P2}$ . . . time duration of second pressure pulse
$\Delta t_R$ . . . time duration between successive actuations
10 . . . imaging apparatus
20 . . . ink droplet
22 . . . satellite ink droplet
25 . . . print head
30 . . . receiver
40 . . . image source
50 . . . image processor
60 . . . halftoning unit
70 . . . image memory
80 . . . waveform generator
85 . . . amplifier
90 . . . transport mechanism
100 . . . rollers
110 . . . transport control system
120 . . . controller
130 . . . ink pressure regulator
140 . . . ink reservoir
150 . . . conduit
160 . . . transducer
170 . . . ink chambers
175 . . . chamber outlet
177 . . . end of chamber
178 . . . open side of chamber
180 . . . first side wall
185 . . . outside surface of first side wall
190 . . . second side wall
195 . . . outside surface of second side wall
200 . . . ink body
205 . . . cut-out
210 . . . base portion
220 . . . top surface
230 . . . bottom surface
240 . . . addressable electrode layer
250 . . . notch
260 . . . electrical conducting terminal
270 . . . common electrode layer
280 . . . electrical ground
285 . . . image
290 . . . first waveform
300 . . . first pressure wave
310 . . . reflected portion of first pressure wave
315 . . . point where reflected portion dies-out
320 . . . sensor
325 . . . sensor diaphragms
330 . . . second voltage waveform
340 . . . feedback circuit
350 . . . third voltage waveform
360 . . . second pressure wave
365 . . . feed-back loop
370 . . . switch

What is claimed:

1. An imaging apparatus having a chamber therein, comprising:

(a) a transducer coupled to the chamber for inducing a first pressure wave in the chamber, the first pressure wave having a reflected portion; with the reflected portion having a first waveform; and (b) a sensor coupled to the chamber for sensing the first waveform of the reflected portion and connected to said transducer for actuating said transducer in response to the reflected portion sensed thereby, so that said transducer actuates to induce a second pressure wave in the chamber having a second waveform based on the first waveform for damping the reflected portion.

2. The apparatus of claim 1, further comprising a feedback circuit interconnecting said sensor and said transducer for controllably actuating said transducer.

3. The apparatus of claim 1, wherein said sensor is integrally formed with said transducer.

4. An imaging apparatus having a chamber therein, comprising:

(a) a transducer coupled to the chamber for inducing a first pressure wave in the chamber, the first pressure wave having an oscillating reflected portion with the reflected portion having a waveform; and (b) a sensor coupled to the chamber for sensing the waveform of the oscillating reflected portion and for generating a sensor output signal in response to the oscillating reflected portion sensed thereby, said sensor output signal being convertible to a transducer drive signal, said sensor connected to said transducer for transmitting the transducer drive signal, to said transducer in order to actuate said transducer, so that said transducer actuates to induce a second pressure wave in the chamber having a second waveform based on the first waveform for damping the oscillating reflected portion of the first pressure wave.

5. The apparatus of claim 4, further comprising a feedback circuit interconnecting said sensor and said transducer to control the sensor output signal transmitted to said transducer in order to controllably actuate said transducer.

6. The apparatus of claim 4, wherein said sensor is integrally formed with said transducer.

7. An imaging apparatus capable of inhibiting inadvertent ejection of a droplet from a fluid body residing in the imaging apparatus, comprising:

(a) a print head defining a chamber having the fluid body disposed therein;

(b) a transducer in fluid communication with the fluid body for inducing a first pressure wave in the fluid body, the first pressure wave having an oscillating reflected portion of a first amplitude and a first phase sufficient to inadvertently eject the droplet;

(c) a waveform generator and amplifier connected to said transducer for supplying a first voltage waveform to said transducer, so that said transducer induces the first pressure wave in the fluid body;

(d) a sensor in fluid communication with the fluid body for sensing the first amplitude and first phase of the oscillating reflected portion and for generating a second voltage waveform in response to the first amplitude and first phase of the oscillating reflected portion sensed thereby; and (e) a feedback circuit connected to said sensor for receiving the second voltage waveform generated by said sensor and for converting the second voltage waveform to a third voltage waveform and connected to said amplifier and transducer, which supplies the amplified third voltage waveform to said transducer, so that said transducer controllably actuates in response to the third voltage waveform supplied thereto for inducing a second pressure wave in the fluid body, the second pressure wave having a second amplitude and a second phase based upon the first amplitude and first phase for damping the first amplitude and first phase of the oscillating reflected portion of the first pressure wave in order to the inhibit inadvertent ejection of the droplet.

8. The apparatus of claim 7, wherein said sensor and said feedback circuit define a feed-back loop.

9. The apparatus of claim 8, further comprising a switch capable of switching between a first operating mode and a second operating mode, said switch connecting said waveform generator to said transducer while switched to the first operating mode and connecting said sensor to said transducer while switched to the second operating mode.

10. The apparatus of claim 7, wherein said sensor is integrally formed with said transducer.

11. The apparatus of claim 7, wherein said transducer is formed of a piezoelectric material responsive to the first and second voltage waveforms.

12. The apparatus of claim 7, wherein said sensor is formed of a piezoelectric material responsive to the oscillating reflected portion.

13. A print head, comprising:

(a) a transducer for inducing a first pressure wave in a chamber defined therein, the first pressure wave having a reflected portion with the reflected portion having a first waveform; and (b) a sensor coupled to the chamber for sensing the waveform of the reflected portion and connected to said transducer for actuating said transducer in response to the reflected portion sensed thereby, so that said transducer actuates to induce a second pressure wave in the chamber having a second waveform based on the first waveform for damping the reflected portion.

14. The print head of claim 13, wherein said sensor is integrally formed with said transducer.

15. A print head, for use in an imaging apparatus print head comprising:

(a) a transducer defining a chamber therein for inducing a first pressure wave in the chamber, the first pressure wave having an oscillating reflected portion with the reflected portion having a first waveform; and (b) a sensor coupled to the chamber for sensing the oscillating reflected portion and for generating a sensor output signal in response to the oscillating reflected portion sensed thereby, said sensor connected through a feedback circuit to said transducer for transmitting a calculated signal, based on the sensor output signal to said transducer for actuating said transducer, so that said transducer actuates to induce a second pressure wave in the chamber having a second waveform based on the first waveform for damping the oscillating reflected portion of the first pressure wave.

16. The print head of claim 15, wherein said sensor is integrally formed with said transducer.

17. A print head for use in an imaging apparatus capable of inhibiting inadvertent ejection of a droplet from a fluid body residing in the print head, comprising:

(a) a transducer defining a chamber having the fluid body disposed therein, said transducer in fluid communication with the fluid body for inducing a first pressure wave in the fluid body in response to a first voltage waveform supplied to said transducer, the first pressure wave having an oscillating reflected portion of a first amplitude and a first phase sufficient to inadvertently eject the droplet; and (b) a sensor in fluid communication with the fluid body for sensing the first amplitude and first phase of the oscillating reflected portion and for generating a second voltage waveform in response to the oscillating reflected portion sensed thereby, the second voltage waveform being convertible into a third voltage waveform supplied to said transducer for controlling said transducer, so that said transducer controllably actuates in response to the third voltage waveform for inducing a second pressure wave in the fluid body, the second pressure wave having a second amplitude and a second phase based upon the first amplitude and first phase for damping the first amplitude and first phase of the oscillating reflected portion of the first pressure wave in order to inhibit inadvertent ejection of the droplet.

18. The print head of claim 17, wherein said sensor is integrally formed with said transducer.

19. The print head of claim 17, wherein said transducer is formed of piezoelectric material.

20. The print head of claim 17, wherein said sensor is formed of piezoelectric material.

21. A method of assembling an imaging apparatus capable of damping a reflected portion of a first pressure wave-formed in a chamber disposed in the apparatus, comprising the steps of:

(a) coupling a transducer to the chamber for inducing the first pressure wave in the chamber, the first pressure wave having a reflected portion with the reflected portion having a first waveform;

(b) coupling a sensor to the chamber for sensing the reflected portion; and (c) connecting the sensor through a feedback circuit to the transducer for actuating the transducer in response to the reflected portion sensed by the sensor, so that the transducer actuates to induce a second pressure wave in the chamber having a second waveform based upon the first waveform for damping the reflected portion.

22. The method of claim 21, further comprising the step of interconnecting the sensor and the transducer by means of a feedback circuit for controllably actuating the transducer.

23. The method of claim 21, further comprising the step of integrally forming the sensor with the transducer.

24. A method of assembling an imaging apparatus capable of damping a reflected portion of a first pressure wave formed in a chamber disposed in the apparatus, comprising the steps of:

(a) coupling a transducer to the chamber for inducing a first pressure wave in the chamber, the first pressure wave having an oscillating reflected portion with the reflected portion have a first waveform;

(b) coupling a sensor to the chamber for sensing the first waveform of the oscillating reflected portion and for generating a sensor output signal in response to the oscillating reflected portion sensed thereby; and (c) connecting the sensor to the transducer for transmitting the sensor output signal to the transducer for actuating the transducer, so that the transducer actuates to induce a second pressure wave in the chamber having a second waveform based upon the first waveform for damping the oscillating reflected portion of the first pressure wave, said sensor output signal being convertible to a transducer drive signal.

25. The method of claim 24, further comprising the step of interconnecting the sensor and the transducer by means of a feedback circuit to control the sensor output signal transmitted to the transducer in order to controllably actuate the transducer.

26. The method of claim 24, further comprising the step of integrally forming the sensor with the transducer.

27. A method of assembling an imaging apparatus capable of inhibiting inadvertent ejection of a droplet from a fluid body residing in the imaging apparatus, comprising the steps of:

(a) forming a print head defining a chamber sized to hold the fluid body therein;

(b) disposing a transducer to be in fluid communication with the fluid body for inducing a first pressure wave in the fluid body, the first pressure wave having an oscillating reflected portion of a first amplitude and a first phase sufficient to inadvertently eject the droplet;

(c) connecting a waveform generator to the transducer for supplying a first voltage waveform to the transducer, so that the transducer induces the first pressure wave in the fluid body;

(d) disposing a sensor to be in fluid communication with the fluid body for sensing the first amplitude and first phase of the oscillating reflected portion and for generating a second voltage waveform in response to the first amplitude and first phase of the oscillating reflected portion sensed thereby;

(e) connecting a feedback circuit to the sensor for receiving the second voltage waveform generated by the sensor and for converting the second voltage waveform to a third voltage waveform; and (f) connecting the feedback circuit to an amplifier and transducer which supplies the amplified third voltage waveform to the transducer, so that the transducer controllably actuates in response to the third voltage waveform supplied thereto for inducing a second pressure wave in the fluid body, the second pressure wave having a second amplitude and a second phase based on the first amplitude and first phase of the first wave for damping the first amplitude and first phase of the oscillating reflected portion of the first pressure wave in order to the inhibit inadvertent ejection of the droplet.

28. The method of claim 27, wherein the steps of disposing the sensor and the feedback circuit comprise the step of disposing the sensor and the feedback circuit so as to define a feed-back loop.

29. The method of claim 28, further comprising the step of providing a switch capable of switching between a first operating mode and a second operating mode thereof, the switch connecting the waveform generator to the transducer while switched to the first operating mode and connecting the sensor to the transducer while switched to the second operating mode.

30. The method of claim 27, further comprising the step of integrally forming the sensor with the transducer.

31. The method of claim 27, wherein the step of disposing a transducer comprises the step of disposing a transducer formed of a piezoelectric material responsive to the first and second voltage waveforms.

32. The method of claim 27, wherein the step of disposing a sensor comprises the step of disposing a sensor formed of a piezoelectric material responsive to the second voltage waveform.

33. A method of assembling a print head for use in an imaging apparatus, comprising the steps of:

(a) providing a transducer for inducing a first pressure wave in a chamber defined therein, the first pressure wave having a reflected portion with the reflected portion having;

(b) coupling a sensor to the chamber for sensing the waveform of the reflected portion; and (c) connecting the sensor to the transducer for actuating the transducer in response to the reflected portion sensed thereby, so that the transducer actuates to induce a second pressure wave in the chamber having a second waveform for damping the reflected portion.

34. The print head of claim 33, further comprising the step of integrally forming the sensor with the transducer.

35. A method of assembling a print head for use in an imaging apparatus, comprising the steps of:

(a) providing a transducer defining a chamber therein for inducing a first pressure wave in the chamber, the first pressure wave having an oscillating reflected portion With the reflected portion having a first waveform;

(b) coupling a sensor to the chamber for sensing the oscillating reflected portion and for generating a sensor output signal in response to the oscillating reflected portion sensed thereby; and (c) connecting the sensor to the transducer for transmitting the sensor output signal through a feedback circuit to the transducer for actuating the transducer, so that the transducer actuates to induce a second pressure wave in the chamber having a second waveform based on the first waveform for damping the oscillating reflected portion of the first pressure wave.

36. The print head of claim 35, further comprising the step of integrally forming the sensor with the transducer.

37. A method of assembling a print head capable of inhibiting inadvertent ejection of a droplet from a fluid body residing in the print head, comprising the steps of:

(a) providing a transducer defining a chamber capable of holding the fluid body therein, the transducer disposed to be in fluid communication with the fluid body for inducing a first pressure wave in the fluid body in response to a first voltage waveform supplied to the transducer, the first pressure wave having an oscillating reflected portion of a first amplitude and a first phase sufficient to inadvertently eject the droplet; and (b) disposing a sensor to be in fluid communication with the fluid body for sensing the first amplitude and first phase of the oscillating reflected portion and for generating a second voltage waveform in response to the oscillating reflected portion sensed thereby, the second voltage waveform being convertible into a third voltage waveform to be supplied to the transducer for controlling the transducer, so that the transducer controllably actuates in response to the third voltage waveform for inducing a second pressure wave in the fluid body, the second pressure wave having a second amplitude and a second phase damping the first amplitude and first phase of the oscillating reflected portion of the first pressure wave in order to inhibit inadvertent ejection of the droplet.

38. The print head of claim 37, further comprising the step of integrally forming the sensor with the transducer.

39. The print head of claim 37, wherein the step of providing a transducer comprises the step of providing a transducer formed of a piezoelectric material responsive to the first and second voltage waveforms.

40. The print head of claim 37, wherein the step of disposing a sensor comprises the step of disposing a sensor formed of a piezoelectric material responsive to the oscillating reflected portion.

* * * * *